United States Patent [19]

Lowry et al.

[11] 4,025,937

[45] May 24, 1977

[54] WEB TRANSPORT APPARATUS

[75] Inventors: Harold D. Lowry; Robert F. Allen, both of Rochester, N.Y.

[73] Assignee: Eastman Kodak Company, Rochester, N.Y.

[22] Filed: Aug. 15, 1975

[21] Appl. No.: 605,352

[52] U.S. Cl. ..... 354/318; 354/297; 354/321; 354/339

[51] Int. Cl.[2] ..... G03D 5/00

[58] Field of Search ..... 354/318, 317, 319, 322, 354/339, 321, 297

[56] References Cited

UNITED STATES PATENTS

| | | | |
|---|---|---|---|
| 2,689,729 | 9/1954 | Debrie | 354/321 |
| 3,512,467 | 5/1970 | Schafler | 354/322 |
| 3,680,803 | 8/1972 | Takata | 354/319 |
| 3,690,758 | 9/1972 | Knechtel et al. | 354/339 |

FOREIGN PATENTS OR APPLICATIONS

| | | | |
|---|---|---|---|
| 1,152,445 | 5/1969 | United Kingdom | 354/297 |

*Primary Examiner*—Stephen J. Tomsky
*Attorney, Agent, or Firm*—Steve W. Gremban

[57] ABSTRACT

A transport apparatus comprising a transport strip wrapped helically around a stationary porous conduit closed off at one end. Liquid under pressure is forced into the open end of the conduit and through the openings in the periphery of the porous conduit, producing a liquid layer between the outer conduit surface and transport strip. A web to be transported, of random length and width, is inserted between the transport strip and the outer surface of the porous conduit and becomes adjoined to the transport strip under the influence of liquid pressure and liquid cohesion. Thus, advancing the transport strip also advances the web, both being supported by the liquid layer which acts as a liquid bearing. Further, if the web is a photographic film or other processable material and the liquid is a suitable processing solution, the liquid layer also serves as a processing medium.

4 Claims, 2 Drawing Figures

WEB TRANSPORT APPARATUS

BACKGROUND OF THE INVENTION

1. Field of the Invention

This invention relates to an apparatus for transporting webs of random length and width along the path of a transport strip that is wrapped helically around one or more porous conduits.

2. Description of the Prior Art

U.S. application Ser. No. 490,155, now U.S. Pat. No. 3,968,510, by one of the present inventors, discloses a porous conduit web processing apparatus employing an enclosed conduit, such as a tube closed off at one end and having closely spaced openings, through which a liquid processing solution introduced into the center of the tube under pressure can reach the outer surface of the tube. Means are provided for directing a web helically around the periphery of the tube. When the liquid processing solution is directed outwardly through the openings in the tube, a liquid layer is formed between the outer surface of the tube and the web. Thus, the web that is helically wrapped around the tube is the web or film to be processed by the liquid processing solution emanating from the tube.

The above application also discloses guiding means for guiding and assuring transport of the web along the predescribed helical path. The disclosed guiding means accepts webs of random length but having a predetermined width. While the guiding means disclosed in said application perform their purpose adequately, they cannot accommodate random web widths.

Dutch Pat. No. 66,953 discloses a processing apparatus in which the web to be processed is guided through various processing solutions by an advancing metal band to which the film adheres. The metal band is not supported as it passes through the processing solutions; the rigidity of the metal band is relied upon to maintain the proper path. Nevertheless, the metal band is flexible and subject to drafts and vibrations causing the band to oscillate, thereby resulting in inconsistent agitation and uneven development. In addition, the processing apparatus is not suitable for random lengths of film since a certain amount of film tension is required to keep the film adjoined to the metal band. In fact, only relatively long lengths of film may be conveniently processed in this disclosed processing apparatus.

SUMMARY OF THE INVENTION

In accordance with the present invention, a web transport apparatus for use with a stationary porous conduit is disclosed which comprises a transport strip wrapped helically around the porous conduit closed off at one end. When liquid under pressure is forced through the open end and into the center of the conduit and through openings in the outer surface of the porous conduit, a liquid layer is formed between the transport strip and the outer surface of the porous conduit. The transport strip is advanced by a suitable driving means so as to move around the porous conduit at a predetermined rate, the liquid layer serving as a bearing between the porous conduit and the transport strip. To transport a web, it is only necessary to insert the end of the web between the outer surface of the porous conduit and the transport strip, whereby liquid pressure and liquid cohesion effects tend to adjoin the web to the transport strip. The transport strip thus acts as a carrier for the web and enables webs of random length and width to be transported without adjustment to the transport apparatus.

The invention has particular advantage when applied to a porous conduit processor in that films of various length and widths can be processed without modification to the processor.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENT

Because web transport apparatus for photographic processors are well known, the present description will be directed to elements forming part of, or cooperating more directly with, apparatus with the present invention. Web transport elements not specifically shown or described should be understood to be selectable from those known in the art.

Figure 1:
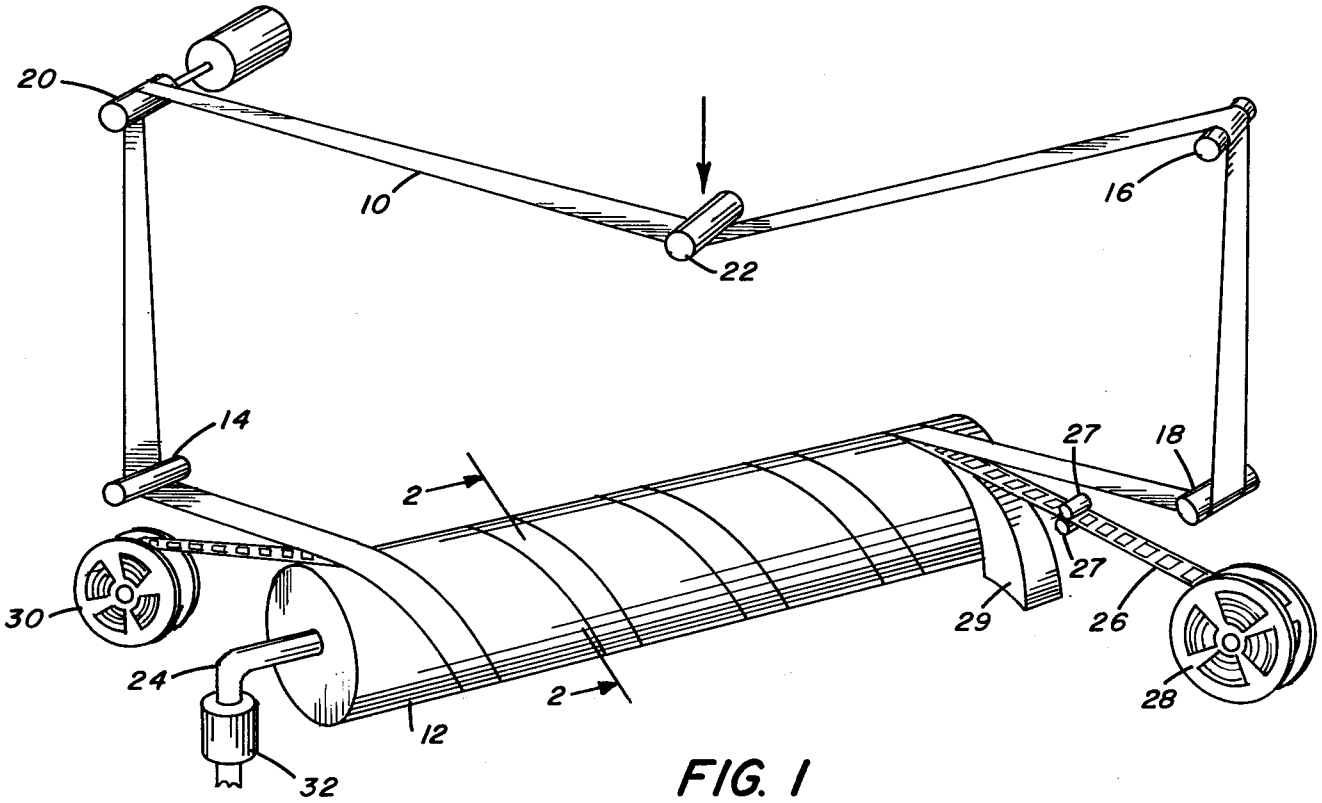
FIG. 1 is a perspective view of a preferred embodiment of the present invention, showing a web transport apparatus suitable for a porous conduit processor.
Figure 2:
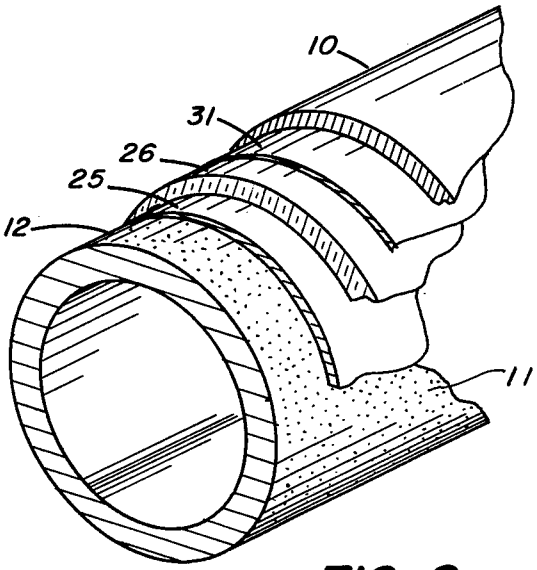
FIG. 2 is a segmental exploded view in perspective taken substantially along line 2—2 of FIG. 1.

Referring now to FIG. 1, the disclosed embodiment of the invention comprises a continuous loop transport strip 10 wrapped helically around a stationary porous conduit 12 closed off at one end and having a plurality of holes or openings 11 in the peripheral wall thereof. Guide rollers 14, 16 and 18 serve to guide the transport strip 10 from the porous conduit 12, to a driver roller 20, across a tension roller 22, and back to the porous conduit 12. A supply conduit 24 supplies liquid to the open end of the conduit 12 for discharge through the openings 11 in the outer surface of the porous conduit 12, thereby forming a liquid layer 25 as seen in FIG. 2 which supports the transport strip 10 as it advances over the porous conduit 12. A web 26 from a supply reel 28 is inserted between the transport strip 10 and the outer surface of the porous conduit 12, until liquid cohesion and friction between the web 26 and the transport strip 10 has provided sufficient drag to advance the remainder of the web 26 with the transport strip 10. A mechanical assisting means such as a pair of pinch rollers 27 which also act as drive rollers may be necessary in the case of a heavy supply reel 28. The pinch rollers 27 provide additional assistance to help the web 26 to be advanced with the transport strip 10. The web 26 is thereby driven against a guide member 29 which guides the web between the transport strip 10 and the outer surface of the porous conduit 12.

The liquid emanating from the openings 11 in the porous conduit 12 exerts a pressure on the web 26 tending to press the web 26 against the transport strip 10. Liquid 31 (FIG. 2) sandwiched between the web 26 and the transport strip 10 causes the web 26 and the transport strip 10 to cohere. (This liquid cohesion effect is similar to the sticking together of two pieces of wet paper). Thus, under the influence of liquid pressure and liquid cohesion, the web 26 becomes adjoined to the transport strip 10, thereby causing the web 26 to be advanced with the transport strip 10. As the web 26 leaves the porous conduit 12, it is preferably squeegeed, dried and then wrapped onto a take-up reel 30.

The liquid layer 31 (FIG. 2) does not necessarily comprise one smooth continuous film. In actual practice, depending upon the width of the web 26, the width of the transport strip 10, the rate at which processing solution flows from the porous conduit 12, and other factors, the liquid layer 31 may have air spaces, air pockets, bubbles or the like. The presence of air spaces, pockets, bubbles, etc., does not affect the operation of the transport apparatus, enough cohesion being produced between those portions of the transport strip 10 and the web 26 which are separated by liquid, to adequately adjoin the web 26 and the transport strip 10 for purposes of advancement of the web 26.

If it is desired to process a web material, for example a photographic film, the disclosed embodiment is readily adapted to that purpose. For this application, the web 26 is the unprocessed photographic film; and the supply means 24 directs liquid processing solution through the openings 11 in the porous conduit 12. The web 26 is inserted as before, between the transport strip 10 and the outer surface of the porous conduit 12, care being taken to orient the web 26 with its base side facing the transport strip 10 and with the emulsion side, i.e., the side to be processed, facing the porous conduit 12. Thus, the emusion side of the web 26 is supported by a liquid layer of processing solution, and processing occurs as the web 26 is advanced over the porous conduit 12.

Since the liquid layer is sustained by a constant flow of processing solution, a high degree of agitation is obtainable, thereby permitting uniform and repeatable processing. The amount of agitation may be adjusted by a pressure regulator 32 which controls the pressure at which the supply means 24 directs processing solution through the openings 11 in the porous conduit 12. If several processing steps with various processing solutions (developer, stop bath, fix, wash, etc.) are to be effected, as many porous conduits as necessary may be added to constitute the complete processing unit. The complete unit may contain a single transport strip threaded around all porous conduits in the unit, or several separate transport strips, one for each processing station, to prevent contaminating the processing solution of one station with solution from the previous station. The transport strips may be either continuous loops or discrete lengths.

The particular porous conduit shown in the drawings is stationary and has a generally circular cross section. The cross section of the porous conduit may possess any shape provided there are no sharp edges. For example, it is within the scope of the invention to substitute a porous conduit having a variety of shapes such as an elliptical or concave cross section. Also within the scope of the invention is a generally circular or cylindrical porous conduit which is rotatable about its axis.

The invention has been described in detail with particular reference to preferred embodiments thereof, but it will be understood that variations and modifications can be effected within the spirit and scope of the invention. For example, in accordance with the invention, the transport strip need not be a planar material such as film leader. Alternatively, the transport strip 10 may comprise a rubber belt material having a circular, or other shape, cross section.

What is claimed is:

1. An apparatus for transporting a web over a porous conduit, which porous conduit has an inner surface and an outer surface and openings extending from the inner surface to the outer surface, and the porous conduit having a liquid under pressure directed outwardly through the openings, said apparatus comprising:

a transport strip wrapped helically around the porous conduit so that a web inserted between said transport strip and the porous conduit is pushed against said transport strip by the outwardly directed liquid from the porous conduit, and the web becomes adjoined to said transport strip under the influence of liquid cohesion produced by liquid sandwiched between the web and said transport strip; and means for advancing said transport strip, thereby causing the adjoined web to be advanced with said transport strip over the porous conduit.

2. A web transport apparatus comprising:

a porous conduit having an inner surface and an outer surface and openings extending from said inner surface to said outer surface;

a transport strip wrapped helically around said conduit;

means for supplying a liquid under pressure to said conduit for discharge outwardly through said openings in said conduit;

means for advancing said transport strip over said conduit; and means for inserting a web between said transport strip and said outer surface of said conduit, whereby the web is pushed against said transport strip by the outwardly directed liquid from the porous conduit, and the web becomes adjoined to said transport strip under the influence of liquid cohesion produced by liquid sandwiched between the web and said transport strip.

3. An apparatus for processing a web with a liquid processing solution, said apparatus comprising:

a stationary porous conduit having an inner surface and an outer surface and openings extending from said inner surface to said outer surface;

a transport strip wrapped helically around said conduit;

means for supplying a liquid processing solution to said conduit for discharge outwardly through said openings in said conduit, whereby a web to be processed inserted between said transport strip and said outer surface of said conduit is pushed against said transport strip by the outwardly directed liquid from said porous conduit, and the web becomes adjoined to said transport strip under the influence of liquid cohesion produced by liquid processing solution sandwiched between the web and said transport strip; and means for advancing said transport strip over said conduit, enabling the web to be processed by the liquid processing solution while being advanced with said transport strip over said porous conduit.

4. An apparatus as claimed in claim 3 further including means for adjusting the rate at which liquid processing solution is supplied to said conduit by said supply means, whereby the rate at which the liquid processing solution flows from said openings in said conduit may be adjusted.

* * * * *